US008749536B2

(12) United States Patent
Shiu et al.

(10) Patent No.: US 8,749,536 B2
(45) Date of Patent: Jun. 10, 2014

(54) SOURCE DRIVER AND DISPLAY APPARATUS

(75) Inventors: Cheng-Lin Shiu, Miaoli (TW); Kuan-Jung Lee, Miaoli (TW)

(73) Assignee: Fitipower Integrated Technology, Inc., Hsinchu City (TW)

( * ) Notice: Subject to any disclaimer, the term of this patent is extended or adjusted under 35 U.S.C. 154(b) by 189 days.

(21) Appl. No.: 13/285,021

(22) Filed: Oct. 31, 2011

(65) Prior Publication Data

US 2012/0280959 A1 Nov. 8, 2012

(30) Foreign Application Priority Data

May 3, 2011 (TW) ..... 100115402 A

(51) Int. Cl.
*G09G 5/00* (2006.01)

(52) U.S. Cl.
USPC ..... 345/204; 345/211; 345/100

(58) Field of Classification Search
USPC ..... 345/95, 96, 99, 209, 214, 100, 204, 345/211; 327/108; 307/263, 443, 475
See application file for complete search history.

(56) References Cited

U.S. PATENT DOCUMENTS

| | | | | |
|---|---|---|---|---|
| 5,122,690 | A * | 6/1992 | Bianchi | 326/87 |
| 7,750,881 | B2 * | 7/2010 | Yen | 345/95 |
| 2004/0036670 | A1 * | 2/2004 | Chung | 345/99 |
| 2009/0243665 | A1 * | 10/2009 | Kumar et al. | 327/108 |
| 2010/0164926 | A1 | 7/2010 | Huang et al. | |
| 2010/0271364 | A1 * | 10/2010 | Nishimura | 345/214 |
| 2011/0133780 | A1 * | 6/2011 | Shau | 326/87 |
| 2011/0157150 | A1 * | 6/2011 | Wu | 345/214 |

* cited by examiner

*Primary Examiner* — Lun-Yi Lao
*Assistant Examiner* — Johny Lau
(74) *Attorney, Agent, or Firm* — Novak Druce Connolly Bove + Quigg LLP

(57) ABSTRACT

A source driver includes an output buffer, a first switch, a second switch, a third switch, a first transistor, and a second transistor. The output buffer includes a first terminal for outputting a plurality of drive voltage to drive a display panel, a second terminal for outputting a first control signal, and a third terminal for outputting a second control signal. The first switch is connected between the first terminal and a display panel. The first transistor includes a first electrode connected to the second terminal via the second switch, a second electrode connected to a first power supply, and a third electrode connected between the first switch and the display panel. The second transistor includes a fourth electrode connected to the third terminal via the third switch, a fifth electrode connected to a second power supply, and a sixth electrode connected to the third electrode of the first transistor.

16 Claims, 2 Drawing Sheets

SOURCE DRIVER AND DISPLAY APPARATUS

BACKGROUND

1. Technical Field

The disclosed embodiments relate to source drivers, and more particularly to a source driver and a display apparatus.

2. Description of Related Art

Referring to FIG. 2, a source driver 800 includes a first output buffer 12, a second output buffer 14, a first output switch 16, a second output switch 18, a charge-sharing switch 20, a first resistor R1, and a second resistor R2. The first output buffer 12 is used for enhancing a first pixel signal and outputting a first enhanced pixel signal, and the second output buffer 14 is used for enhancing a second pixel signal and outputting a second enhanced pixel signal. The first output switch 16 and the second output switch 18 are simultaneously controlled by a first control signal, and the charge-sharing switch 20 is controlled by a second control signal. The first resistor R1 and the second resistor R2 are electrostatic discharge (ESD) protection resistors, and the resistance of each of the ESD protection resistors is R.

When the first control signal is changed to a high level, the first output switch 16 and the second output switch 18 are turned on, the charge-sharing switch 20 is cut off by the second control signal, the system enters into an output timing mode T1. In the output timing mode T1, the first enhanced pixel signal and the second enhanced pixel signal drive a display panel 900 respectively through the first resistor R1 and the second resistor R2.

Next, the first control signal is changed from the high level to a low level, the first output switch 16 and the second output switch 18 are cut off, the charge-sharing switch 20 is turned on by the second control signal, the system enters into a charge-sharing timing mode T2. In the charge-sharing timing mode T2, the electric potential of a first output terminal 24 and a second output terminal 25 reaches the intermediate value.

However, when the first output switch 16 and the second output switch 18 are turned on, the equivalent resistance of the first output switch 16 and the second output switch 18 reduce the driving ability of the source driver 800.

Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout two views.

DETAILED DESCRIPTION

Figure 1:
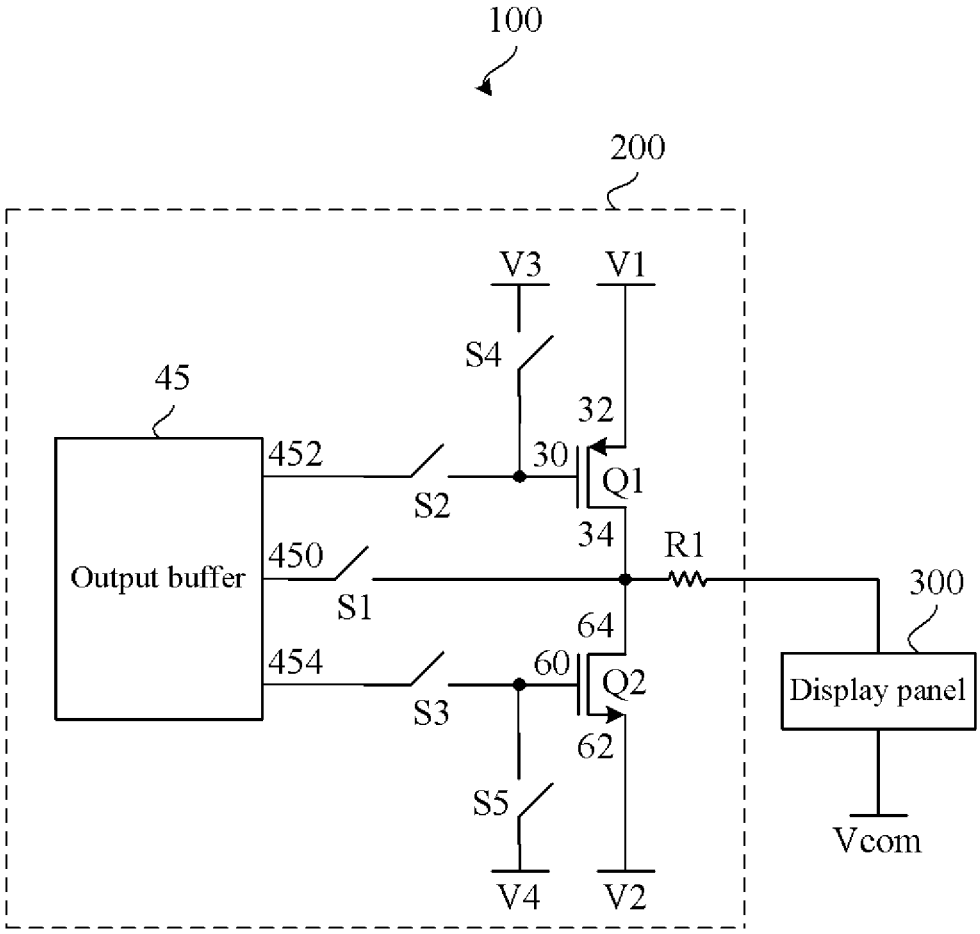
FIG. 1 is a schematic diagram of a display apparatus in accordance with one embodiment.
Figure 2:
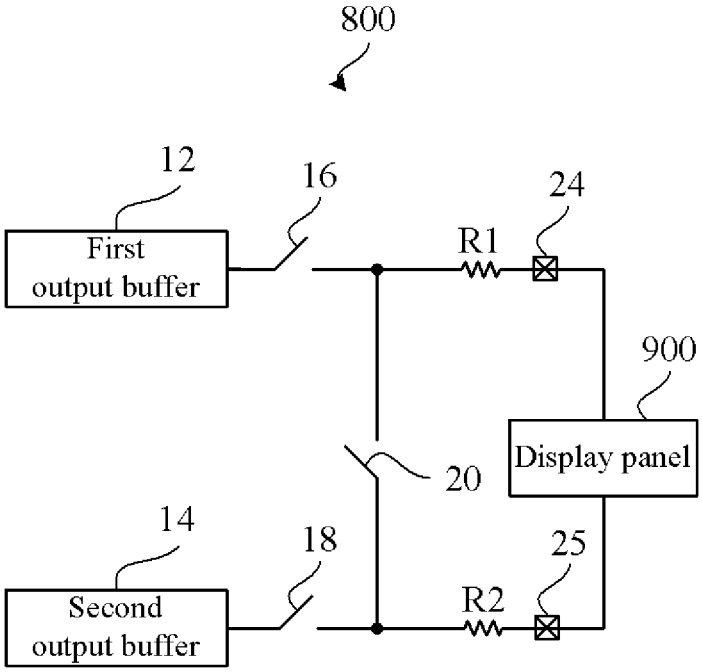
FIG. 2 (RELATED ART)
FIG. 2 is a schematic diagram of a source driver according to the related art.

Referring to FIG. 1, a display apparatus 100 includes a source driver 200 and a display panel 300. The source driver 200 outputs a plurality of drive voltages to drive the display panel 300, a common voltage Vcom is supplied to the display panel 300. In this embodiment, the display panel 300 is a liquid crystal display (LCD).

The source driver 200 includes an output buffer 45, a first switch S1, a second switch S2, a third switch S3, a fourth switch S4, a fifth switch S5, a first transistor Q1, a second transistor Q2, and an electrostatic discharge (ESD) protection resistor R1. The output buffer 45 includes a first terminal 450, a second terminal 452, and a third terminal 454. The first terminal 450 is used for outputting the plurality of drive voltages, the second terminal 452 is used for outputting a first control signal, and the third terminal 454 is used for outputting a second control signal.

One end of the first switch S1 is connected to the first terminal 450, the other end of the first switch S1 is connected to the display panel 300 via the ESD protection resistor R1.

The first transistor Q1 includes a first electrode 30, a second electrode 32, and a third electrode 34. The first electrode 30 is connected to the second terminal 452 via the second switch S2, the second electrode 32 is connected to a first power supply V1, and the third electrode 34 is connected between the first switch S1 and the ESD protection resistor R1. The first electrode 30 is further connected to a third power supply V3 via the fourth switch S4.

The second transistor Q2 includes a fourth electrode 60, a fifth electrode 62, and a sixth electrode 64. The fourth electrode 60 is connected to the third terminal 454 via the third switch S3, the fifth electrode 62 is connected to a second power supply V2, and the sixth electrode 64 is connected to the third electrode 34 of the first transistor Q1. The fourth electrode 60 is further connected to a fourth power supply V4 via the fifth switch S5.

In this embodiment, the first transistor Q1 is a P-channel metal oxide semiconductor field effect transistor, the second transistor Q2 is an N-channel metal oxide semiconductor field effect transistor. The first electrode is a gate electrode, the second electrode is a source electrode, and the third electrode is a drain electrode. The fourth electrode is a gate electrode, the fifth electrode is a source electrode, and the sixth electrode is a drain electrode.

Switches S1, S2, and S3 are simultaneously turned on or off, and switches S4 and S5 are simultaneously turned on or off. When switches S1, S2, and S3 are turned on, switches S4 and S5 are turned off. When switches S1, S2, and S3 are turned off, switches S4 and S5 are turned on.

In other embodiments, switches S1, S2, and S3 are not turned on or off simultaneously, switches S4 and S5 are not turned on or off simultaneously; switches S2 and S4 are not turned on simultaneously, switches S3 and S5 are not turned on simultaneously.

The principle of the source driver 200 is as follows:

When switches S1, S2, and S3 are turned on, switches S4 and S5 are turned off. In this situation, the first electrode 30 of the first transistor Q1 receives the first control signal from the second terminal 452, thus the first transistor Q1 is turned on, and the first power supply V1 outputs a first supply voltage to charge up the display panel 300 via the ESD protection resistor R1, and the first supply voltage V1 is larger than the common voltage Vcom. The fourth electrode 60 of the second transistor Q2 receives the second control signal from the third terminal 454, thus the second transistor Q2 is turned on, and the second power supply V2 outputs a second supply voltage to discharge the display panel 300 via the ESD protection resistor R1, and the second supply voltage V2 is smaller than the common voltage Vcom.

When the first switch S1, the second switch S2, and the third switch S3 are turned off, the fourth switch S4 and the fifth switch S5 are turned on. In this situation, the third power supply V3 outputs a third supply voltage to turn off the first transistor Q1, and the fourth power supply V4 outputs a fourth supply voltage to turn off the second transistor Q2.

In other embodiments, the second terminal 452 is further used for outputting a third control signal, and the third terminal 454 is further used for outputting a fourth control signal; when the first switch S1 is turned off, the second switch S2 and the third switch S3 are turned on. In this situation, the first electrode 30 of first transistor Q1 receives the third control signal and is turned off according to the third control signal, the fourth electrode 60 of second transistor Q2 receives the fourth control signal and is turned off according to the fourth control signal.

When the first switch S1 is turned on and the first terminal 450 outputs the plurality of drive voltages, the plurality of drive voltages charges up or discharges the display panel 300 via the ESD protection resistor R1. The charging and discharging capability of the display panel 300 are limited by the equivalent resistance of conducted first switch S1.

However, when the first transistor Q1 is turned on, the first power supply V1 outputs a first supply voltage to charge up the display panel 300 via the ESD protection resistor R1. When the second transistor Q2 is turned on, the second power supply V2 outputs a second supply voltage to discharge the display panel 300 via the ESD protection resistor R1. The charging and discharging capability of the display panel 300 are not limited by the equivalent resistance of conducted first switch S1, therefore the charging and discharging capabilities of the display panel 300 can be enhanced.

Alternative embodiments will become apparent to those skilled in the art without departing from the spirit and scope of what is claimed. Accordingly, the present invention should be deemed not to be limited to the above detailed description, but rather only by the claims that follow and the equivalents thereof.

What is claimed is:

1. A source driver adapted to drive a display panel, the source driver comprising:

an output buffer comprising a first terminal for outputting a plurality of drive voltages to drive the display panel, a second terminal for outputting a first control signal, and a third terminal for outputting a second control signal;

a first switch connected between the first terminal and the display panel;

an electrostatic discharge protection resistor directly connected in series between the first switch and the display panel;

a second switch;

a first transistor comprising a first electrode connected to the second terminal via the second switch, a second electrode connected to a first power supply, and a third electrode connected between the first switch and the display panel;

a third switch; and a second transistor comprising a fourth electrode connected to the third terminal via the third switch, a fifth electrode connected to a second power supply, and a sixth electrode connected to the third electrode of the first transistor;

wherein when the second switch is turned on, the first transistor receives the first control signal and is turned on according to the first control signal, thus the first power supply outputs the first supply voltage to charge up the display panel; when the third switch is turned on, the second transistor receives the second control signal and is turned on according to the second control signal, thus the second power supply outputs the second supply voltage to discharge the display panel.

2. The source driver of claim 1, wherein a common voltage is supplied to the display panel, the first supply voltage is larger than the common voltage, the second supply voltage is smaller than the common voltage.

3. The source driver of claim 1, wherein the first switch, the second switch and the third switch are simultaneously turned on or off.

4. The source driver of claim 1, wherein when the first switch is turned off, the second switch and the third switch are turned on; the second terminal outputs a third control signal, the third terminal outputs a fourth control signal; the first transistor receives the third control signal and is turned off according to the third control signal, the second transistor receives the fourth control signal and is turned off according to the fourth control signal.

5. The source driver of claim 1, further comprising:

a fourth switch, one end of the fourth switch connected to a third power supply, the other end of the fourth switch connected between the second switch and the first electrode; and a fifth switch, one end of the fifth switch connected to a fourth power supply, the other end of the fifth switch connected between the third switch and the fourth electrode;

wherein when the fourth switch is turned on, the third power supply outputs a third supply voltage to turn off the first transistor; when the fifth switch is turned on, the fourth power supply outputs a fourth supply voltage to turn off the second transistor.

6. The source driver of claim 5, wherein when the second switch is turned on, the fourth switch is turned off; when the fourth switch is turned on, the second switch is turned off; when the third switch is turned on, the fifth switch is turned off; when the fifth switch is turned on, the third switch is turned off.

7. The source driver of claim 5, wherein the fourth switch and the fifth switch are simultaneously turned on or off.

8. The source driver of claim 1, wherein the first transistor is a P-channel metal oxide semiconductor field effect transistor, the second transistor is an N-channel metal oxide semiconductor field effect transistor; the first electrode is a gate electrode, the second electrode is a source electrode, the third electrode is a drain electrode; the fourth electrode is a gate electrode, the fifth electrode is a source electrode, the sixth electrode is a drain electrode.

9. A display apparatus, comprising:

a display panel; and a source driver comprising:

an output buffer comprising a first terminal for outputting a plurality of drive voltages to drive the display panel, a second terminal for outputting a first control signal, and a third terminal for outputting a second control signal;

a first switch connected between the first terminal and the display panel;

an electrostatic discharge protection resistor directly connected in series between the first switch and the display panel;

a second switch;

a first transistor comprising a first electrode connected to the second terminal via the second switch, a second electrode connected to a first power supply, and a third electrode connected between the first switch and the display panel;

a third switch; and a second transistor comprising a fourth electrode connected to the third terminal via the third switch, a fifth electrode connected to a second power supply, and a sixth electrode connected to the third electrode of the first transistor;

wherein when the second switch is turned on, the first transistor receives the first control signal and is turned on according to the first control signal, thus the first power supply outputs the first supply voltage to charge up the display panel; when the third switch is turned on, the second transistor receives the second control signal and is turned on according to the second control signal, thus the second power supply outputs the second supply voltage to discharge the display panel.

10. The display apparatus of claim 9, wherein a common voltage is supplied to the display panel, the first supply voltage is larger than the common voltage, the second supply voltage is smaller than the common voltage.

11. The display apparatus of claim 9, wherein the first switch, the second switch and the third switch are simultaneously turned on or off.

12. The display apparatus of claim 9, wherein when the first switch is turned off, the second switch and the third switch are turned on; the second terminal outputs a third control signal, the third terminal outputs a fourth control signal; the first transistor receives the third control signal and is turned off according to the third control signal, the second transistor receives the fourth control signal and is turned off according to the fourth control signal.

13. The display apparatus of claim 9, wherein the source driver further comprising:

a fourth switch, one end of the fourth switch connected to a third power supply, the other end of the fourth switch connected between the second switch and the first electrode; and a fifth switch, one end of the fifth switch connected to a fourth power supply, the other end of the fifth switch connected between the third switch and the fourth electrode;

wherein when the fourth switch is turned on, the third power supply outputs a third supply voltage to turn off the first transistor; when the fifth switch is turned on, the fourth power supply outputs a fourth supply voltage to turn off the second transistor.

14. The display apparatus of claim 13, wherein when the second switch is turned on, the fourth switch is turned off; when the fourth switch is turned on, the second switch is turned off; when the third switch is turned on, the fifth switch is turned off; when the fifth switch is turned on, the third switch is turned off.

15. The display apparatus of claim 13, wherein the fourth switch and the fifth switch are simultaneously turned on or off.

16. The display apparatus of claim 9, wherein the first transistor is a P-channel metal oxide semiconductor field effect transistor, the second transistor is an N-channel metal oxide semiconductor field effect transistor; the first electrode is a gate electrode, the second electrode is a source electrode, the third electrode is a drain electrode; the fourth electrode is a gate electrode, the fifth electrode is a source electrode, the sixth electrode is a drain electrode.

* * * * *